US009995132B2

(12) United States Patent
Gard et al.

(10) Patent No.: US 9,995,132 B2
(45) Date of Patent: Jun. 12, 2018

(54) EXTERNAL HOLLOW ANTENNA

(71) Applicant: The Charles Machine Works, Inc., Perry, OK (US)

(72) Inventors: Michael F. Gard, Perry, OK (US); Brian K. Bailey, Stillwater, OK (US); Richard F. Sharp, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 225 days.

(21) Appl. No.: 14/733,340

(22) Filed: Jun. 8, 2015

(65) Prior Publication Data

US 2016/0356146 A1 Dec. 8, 2016

Related U.S. Application Data

(60) Provisional application No. 62/008,544, filed on Jun. 6, 2014.

(51) Int. Cl.

| | |
|---|---|
| ***E21B 47/024*** | (2006.01) |
| ***E21B 47/0232*** | (2012.01) |
| ***E21B 7/04*** | (2006.01) |
| ***H01Q 1/04*** | (2006.01) |
| ***E21B 47/022*** | (2012.01) |
| *H01Q 1/42* | (2006.01) |
| *H01Q 1/52* | (2006.01) |
| *H01Q 7/00* | (2006.01) |

(52) U.S. Cl.

CPC ..... *E21B 47/024* (2013.01); *E21B 7/046* (2013.01); *E21B 47/02224* (2013.01); *H01Q 1/04* (2013.01); *H01Q 1/42* (2013.01); *H01Q 1/526* (2013.01); *H01Q 7/00* (2013.01)

(58) Field of Classification Search

CPC ... E21B 47/02224; E21B 47/024; E21B 7/046

See application file for complete search history.

(56) References Cited

U.S. PATENT DOCUMENTS

| | | | | |
|---|---|---|---|---|
| 3,746,106 | A * | 7/1973 | McCullough | E21B 7/04 175/45 |
| 4,684,946 | A * | 8/1987 | Issenmann | E21B 17/003 175/50 |
| 4,899,112 | A | 2/1990 | Clark et al. | |
| 4,907,658 | A * | 3/1990 | Stangl | E21B 7/04 175/19 |

(Continued)

FOREIGN PATENT DOCUMENTS

WO 2014043580 A2 3/2014

OTHER PUBLICATIONS

European Patent Office "Extended Search Report" EPO Form 1507N 06.12, 3 pages.

*Primary Examiner* — D. Andrews
*Assistant Examiner* — Michael A Goodwin
(74) *Attorney, Agent, or Firm* — Tomlinson McKinstry, P.C.

(57) ABSTRACT

A beacon assembly located at a downhole end of a drill string proximate a boring tool. The beacon assembly transmits data to an above-ground receiver. The beacon has a housing with a housing wall located between its sensors, such as gradiometers, accelerometers, and other orientation sensors, and an antenna assembly. The antenna assembly has a protective covering made of electromagnetically transparent material.

10 Claims, 7 Drawing Sheets

(56) References Cited

U.S. PATENT DOCUMENTS

| | | | | |
|---|---|---|---|---|
| 5,160,925 | A * | 11/1992 | Dailey | E21B 47/011 175/40 |
| 6,142,244 | A * | 11/2000 | Hesse | E21B 47/011 175/26 |
| 6,739,413 | B2 | 5/2004 | Sharp et al. | |
| 6,836,218 | B2 * | 12/2004 | Frey | E21B 47/011 324/338 |
| 7,568,532 | B2 | 8/2009 | Kuckes et al. | |
| 8,497,684 | B2 | 7/2013 | Cole et al. | |
| 2002/0010547 | A1 * | 1/2002 | Hall | E21B 7/04 702/6 |
| 2003/0025503 | A1 | 2/2003 | Fanini | |
| 2003/0075319 | A1 | 4/2003 | Chau | |
| 2005/0023036 | A1 * | 2/2005 | Cole | E21B 47/024 175/26 |
| 2006/0161351 | A1 * | 7/2006 | Nickel | E21B 7/04 702/9 |
| 2012/0217023 | A1 | 8/2012 | Chau | |
| 2014/0167766 | A1 * | 6/2014 | Olsson | G01V 3/165 324/329 |

* cited by examiner

EXTERNAL HOLLOW ANTENNA

CROSS REFERENCE TO RELATED APPLICATION

This application claims the benefit of provisional patent application Ser. No. 62/008,544, filed on Jun. 6, 2014, the entire contents of which are incorporated herein by reference.

FIELD

The present invention relates generally to beacons and antennas for use with downhole tools drilling operations.

SUMMARY

The present invention is directed to a downhole tool coupled to a drill string comprising a sensor, an antenna electromagnetically coupled to the sensor, and a wall disposed between the antenna and the sensor. The wall comprises a connection point for connection to the drill string.

In another embodiment, the present invention is directed to a beacon assembly for attachment to a downhole end of a drill string. The drill string comprises a substantially constant first diameter. The beacon assembly comprises a housing wall, an antenna, and a sensor. The housing wall comprises a first portion and a second portion. The first portion has substantially the first diameter. The second portion has a second diameter which is less than the first diameter. The antenna is located about the second portion of the housing wall. The sensor is located within the housing wall electronic communication with the antenna.

DESCRIPTION

Horizontal Directional Drilling (HDD) applications typically employ a subsurface tracking beacon and a walk-over tracking receiver to follow the progress of a horizontal borehole. An example of a walkover receiver and method for use thereof is shown in U.S. Pat. No. 8,497,684 issued to Cole, et, al., the contents of which are incorporated herein by reference. The tracking beacon contains devices to measure pitch, roll (bit angle), beacon battery voltage, beacon temperature, and a variety of other physical parameters. Measured information is transmitted by the beacon using a modulated electromagnetic signal. Transmission of the beacon's signal typically involves an internal antenna consisting of multiple wire turns wrapped around a ferrite rod. The surface tracking receiver contains electronic elements which receive and decode the modulated signal. The surface tracking receiver also detects the signal's field characteristics and measures the beacon's emitted signal amplitude to estimate the beacon's depth and location.

In some cases, the beacon measurements of interest are magnetic field measurements. Certain applications require the use of magnetic field gradiometers, which are instruments used to determine a magnetic field's rate of change along a certain path. Magnetic field gradiometers essentially involve magnetic field measurements separated by a known distance along some axis. Construction of a magnetic field gradiometer in the HDD industry is complicated, not only by the limited axial and radial space available for sensor placement, but also by the need to communicate measurements to the surface receiver by a magnetic field transmission. The lack of space makes it desirable to package beacon electronics elements as densely as possible, but the presence of the antenna's ferrite rod near a gradiometer's magnetic field sensors is known to be capable of disturbing the gradiometer's measurement capability. In the case of the most sensitive sensors, the proximity of a ferrite rod to any of the sensing elements can produce undesirable measurement degradation.

Further, conventional beacon antennas will be inside a beacon housing that attenuates the magnetic field because the beacon housing is conductive and magnetically permeable. To reduce this effect, slots are often provided in the beacon housing. However, limitations include differences in the strength based upon the orientation of the housing, attenuation, and may require specifically clocked housings for accurate measurements.

The present invention packages the antenna away from sensors and outside of the beacon housing. The invention may also be used with a downhole generator that may be integral with the beacon for power, which could be housed in a common housing. The beacon may be used with a single or dual-member drill string. The beacon could also be used with a drive shaft going through the beacon to drive a downhole tool such as in a coiled tubing application.

Figure 1:
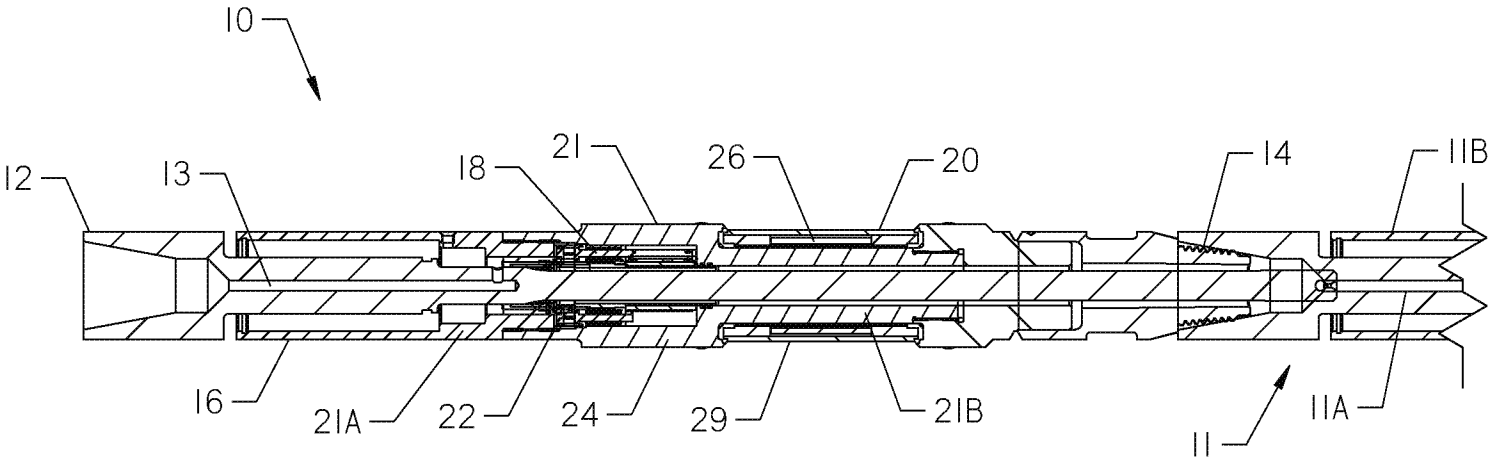
FIG. 1 is a cross-sectional side view of a downhole tool having an external antenna.

With reference now to the figures in general and FIG. 1 in particular, shown therein is a downhole tool 10. The downhole tool 10 is connected on a first end 12 to a drill bit (not shown) and a second end 14 to a drill string 11. As shown, the tool 10 is adapted to connect to a dual member drill string 11 comprising an inner member 11*a* and an outer member 11*b*, though a single member drill string may be utilized with the proposed invention without departing from its spirit. The tool 10 may connect to the drill string 11 at a threaded connection or other known connection at its second end 14. The tool 10 comprises a front tool body 16, a beacon assembly 18, and an antenna assembly 20. The tool 10 comprises a housing wall 21 which is preferably located about a periphery of the beacon assembly 18 but inside the antenna assembly 20. The beacon assembly 18 may allow fluid to pass through the center portion of the tool 10 forming an internal passage 13 of the drill string 11 or with an annulus between the inner member 11*a* and outer member 11*b* of a dual member drill string.

The housing wall 21 preferably has a varying diameter creating a first portion 21*a* and second portion 21*b*, such that the diameter of the housing wall 21 when encasing the beacon assembly 18 (first portion 21*a*) is greater than the diameter of the housing wall when within the antenna assembly 20 (second portion 21*b*). A shoulder may be created between the first portion 21*a* and the second portion 21*b*, or the transition may be tapered or gradual. The housing wall 21 may comprise an opening, or feedthrough 104 (FIG. 5) for the antenna coil 100 (FIG. 5), to traverse between the antenna assembly 20 and the beacon assembly 18.

The front toot body 16 allows fluid flow from within the drill string 11 to a drill bit or other tool as well as transmission of rotation from the inner member 11*a* to the drill bit. The beacon assembly 18 comprises a magnet motor 22 and a generator assembly 24. As relative rotation occurs between the inner member 11*a* and outer member 11*b* of the drill string 11, components of the downhole tool 10 also rotate relative to one another due to connection made at stem weldment. An exemplar generator assembly 24 utilizing a dual-member drill string 11 may be found in U.S. Pat. No. 6,739,413, issued to Sharp, et. al., the contents of which are incorporated herein by reference.

The antenna assembly 20 comprises an antenna 26 and a protective casing 29. The antenna 26 transmits signals generated by the beacon assembly 18 as will be described in further detail with reference to FIGS. 3-5. The protective casing 29 is preferably a magnetically transparent sleeve, a material that has a relative permeability of substantially unity. The casing 29 may comprise cast urethane, plastics, ceramics, or other materials that provide structural protection but create little or no interference with the signal of the antenna 26.

Figure 2:
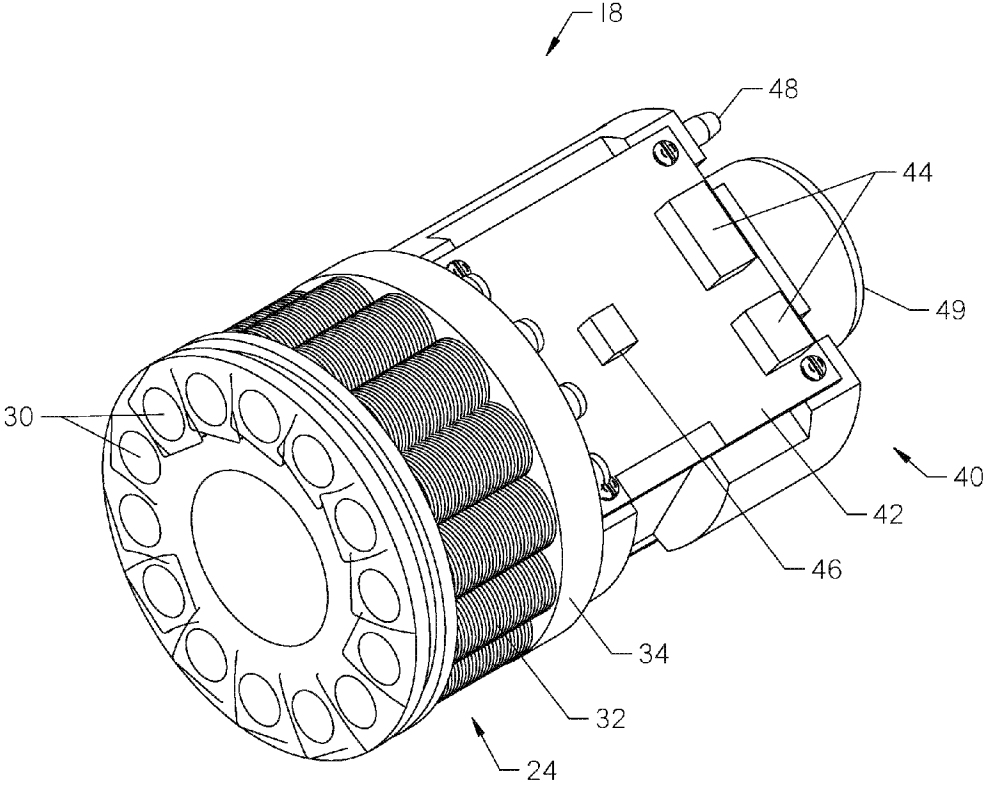
FIG. 2 is a perspective view of a beacon assembly of the downhole tool of FIG. 1.

With reference now to FIG. 2 the beacon assembly 18 is shown in greater detail. The beacon assembly 18 may be rotationally locked to the inner member 11*a* (not shown). The generator assembly 24 comprises stator poles 30, bobbins 32, and a back plate 34. The stator poles 30, when rotated relative to magnet motor 22 (FIG. 1) through fluid flow or relative rotation of the inner 11*a* and outer 11*b* drill members, generate a current to power the tool 10. Alternatively, power for the tool 10 may also be provided by wireline or batteries.

The beacon assembly 18 further comprises a sensor assembly 40. The back plate 34 helps to isolate the generator assembly 24 from the sensor assembly 40. The sensor assembly 40 comprises aboard 42, a sensor 44, and a program port 46. The board 42 provides structural and electrical connectivity for the sensor 44 and program port 46. The board 42 may be curved to match the shape of the beacon assembly 18. The sensor 44 comprises one or more sensors for determining an orientation of the downhole tool 10. Such sensors 44 may comprise one or more yaw, pitch, roll, tension, force, conductivity, or other sensors. For example, an accelerometer may be utilized. The program port 46 allows a user to access data and configure the sensors 44. Further, while the use of sensors 44 is one advantageous use of the antenna assembly 20 (FIG. 3), another transmission source could be utilized with the antenna assembly disclosed below.

Figure 3:
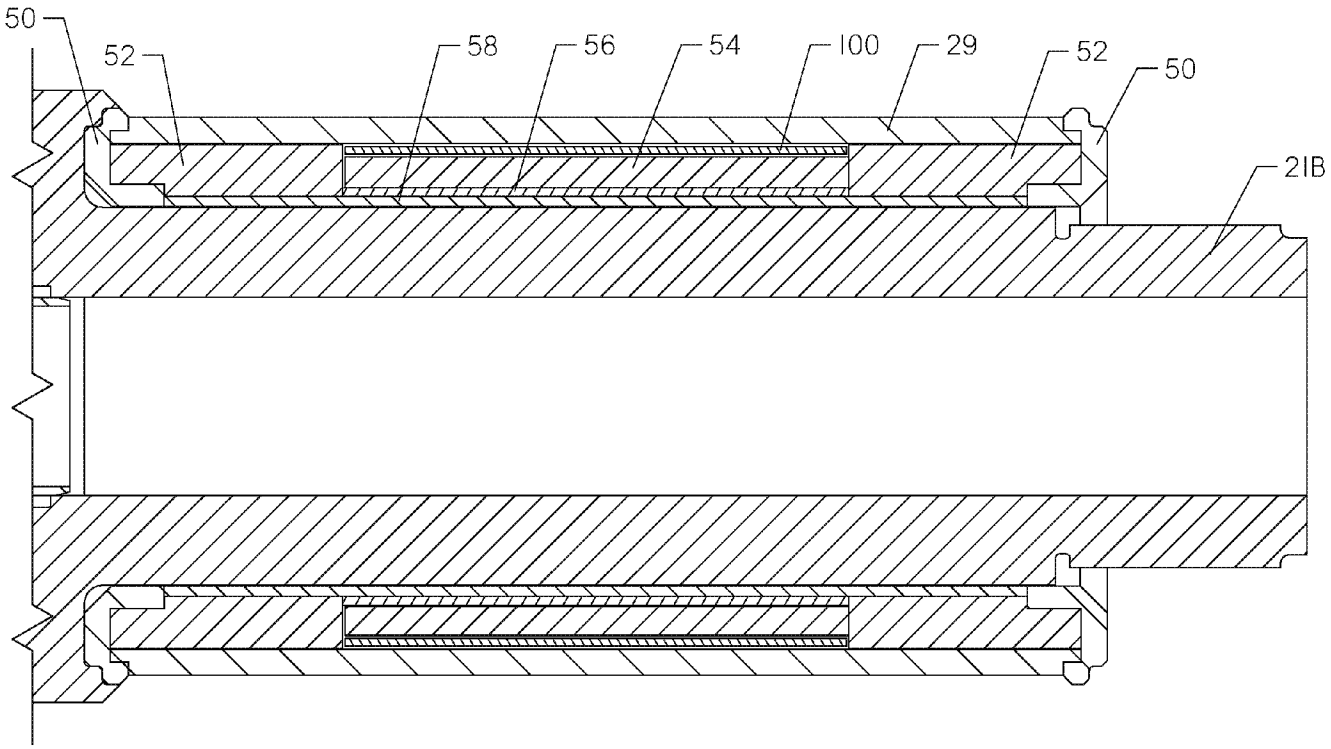
FIG. 3 is a perspective sectional view of the antenna assembly of the downhole tool of FIG. 1.

The antenna assembly (FIG. 3) may also connect to the beacon sensors 44 through port 46, A locating key 48 may be utilized to lock the clock position of the beacon assembly 18 to the antenna assembly 20 (FIG. 3). In this way, a feedthrough 104 (FIG. 5) may be placed between the sensor assembly 40 and the antenna assembly 20 through the housing wall 21 (FIG. 3). As shown, a center tube 49 passes through the beacon assembly 18 to provide fluid flow and optionally provide rotational torque from the drill string 11 (FIG. 1).

With reference to FIG. 3, the antenna 26 comprises an end support 50, a support tube 52, at least one ferrite rod 54, a nonconductive tube 56 and a shield 58. The end support 50 provides an insulating support for the antenna 26 within the tool 10 so that electromagnetic interference of the housing wall 21 at the ends of the antenna 26 is minimized. Further, any electromagnetic interference between the antenna 26 and sensors 44 is also minimized. The support tube 52 is disposed about the housing wall 21 and locates the ferrite rods 54 within the antenna assembly 20. The shield 58 is preferably highly conductive, non-magnetic. Aluminum may be used in the shield 58, as could other materials such as copper. Preferably, the shield covers the end support 50. There may be a further insulator between the shield 58 and the housing wall 21. The nonconductive magnetic field layer, or tube 56 is located between the shield 58 and ferrite rods 54 and insulates them from each other. Further, the tube 56 may be a non-magnetic material such as plastic. Without the nonconductive tube 56 or similar structure, the magnetic field would be pushed outward but some eddy currents would flow within the housing wall 21. The tube 56 may be a hollow cylinder, or may be comprised of multiple pieces with nonconductive, non-magnetic properties.

Figure 5:
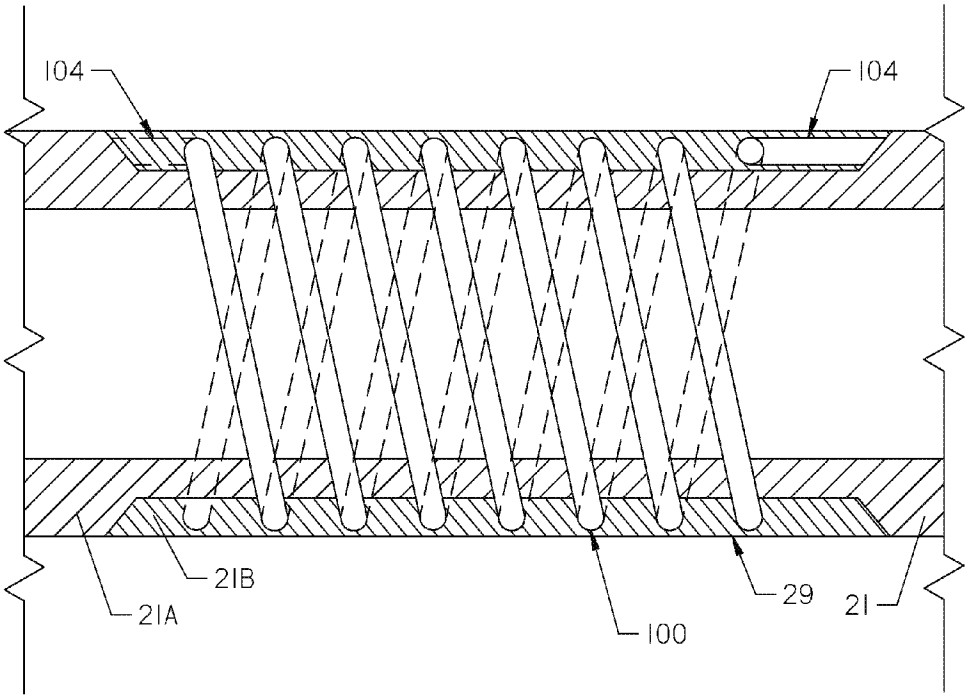
FIG. 5 is a cross-sectional side view of an alternative embodiment of the antenna assembly of the downhole tool with the antenna coil shown un-sectioned for clarity.

The ferrite rods 54 are located between the plastic tube 56 and protective casing 29 and magnify signal strength of the beacon signals corresponding to readings of the beacon assembly 18. An antenna coil 100 (FIG. 5) may be provided about the ferrite rods 54 to transmit the beacon signals. Further, as shown in FIG. 5, the antenna coil 100 may be utilized without ferrite rods. The antenna coil 100 is preferably a single layer to minimize its profile, but a multi-layer antenna may be used. The sensor 44 may be disposed within the coil 100 and within the wall 21.

Figure 4:
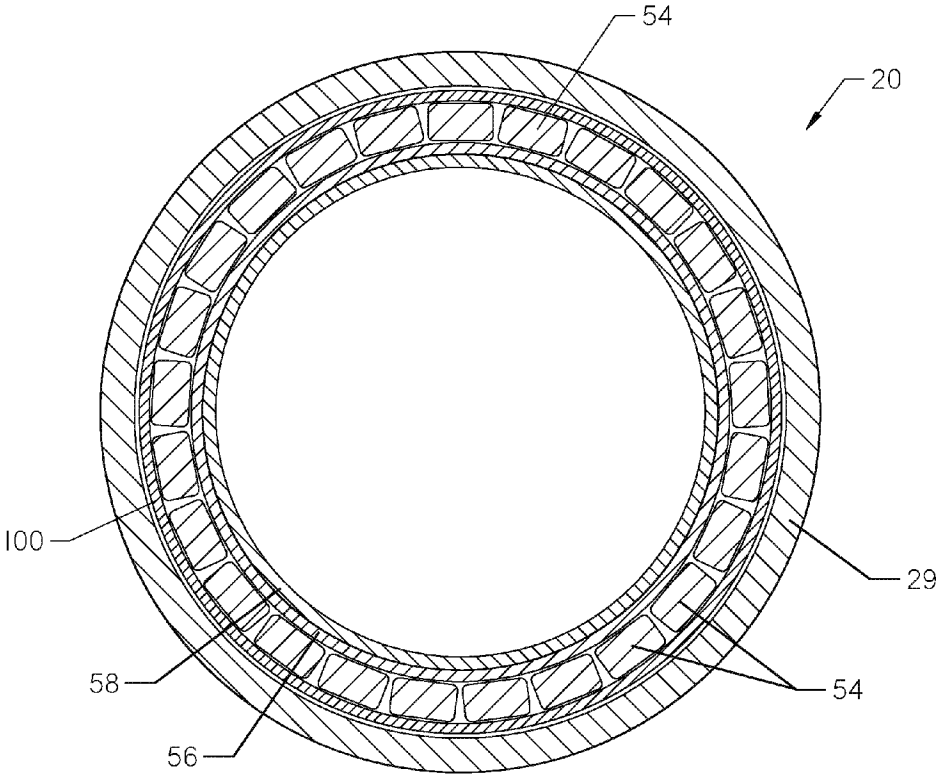
FIG. 4 is a partial sectional end view of the downhole tool, showing the antenna assembly of the downhole tool.
Figure 6:
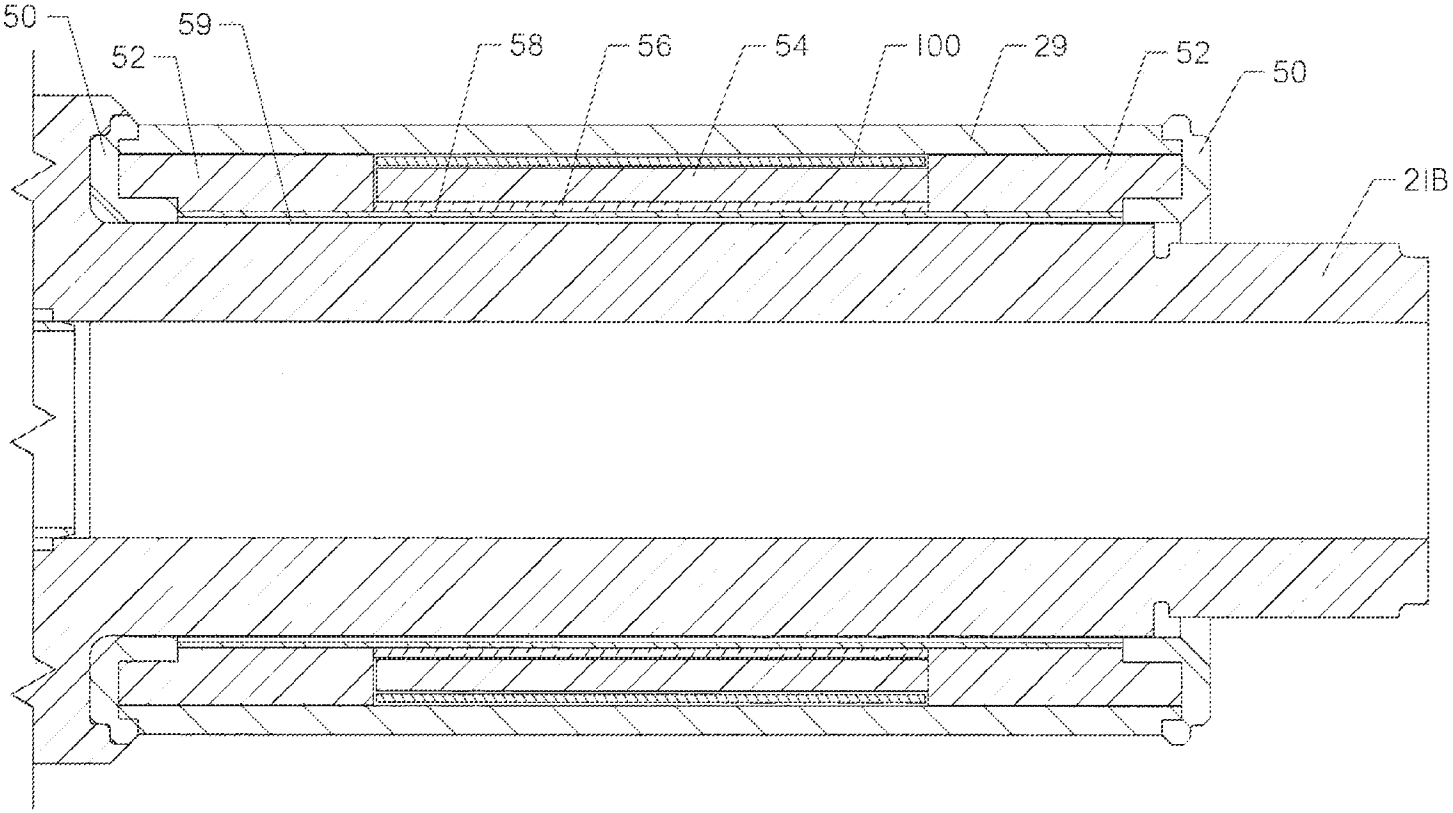
FIG. 6 is a perspective sectional view of another embodiment of the antenna assembly of a downhole tool having an insulating gap between a housing wall and a shield.

With reference now to FIG. 4, the antenna assembly 20 is shown in cross section. The housing wall 21 is removed for clarity. As shown, the antenna assembly 20 comprises twenty-five ferrite rods 54, though other numbers of rods may be used. Additionally, the ferrite rods 54 themselves may be removed and elements of the housing wall 21 may be used with an antenna coil. The antenna coil 100 may be also utilized about the ferrite rods. In general, the arrangement of the antenna assembly 20 from inside to outside is housing wall 21 (FIG. 3), shield 58, tube 56, ferrite rods 54, antenna coil 100 (FIG. 5), protective casing 29. An insulating gap or material 59 may be utilized between the housing wall 21 and shield 58 as shown in FIG. 6. Further, the plastic tube 56 may be replaced with a layer of any non-conductive material, such as air.

In operation, the antenna assembly 20 of FIG. 4 operates when current passes through the antenna coil 100 to generate a magnetic field corresponding to beacon readings. The field passes through the tube 56 and permeates the shield 58 according to skin depth rules. The eddy current induced in the shield 58 will "push" the magnetic field out away from the tool 10, minimizing power loss. The insulating gap 59 prevents eddy currents from reaching the housing wall 21.

Figure 7:
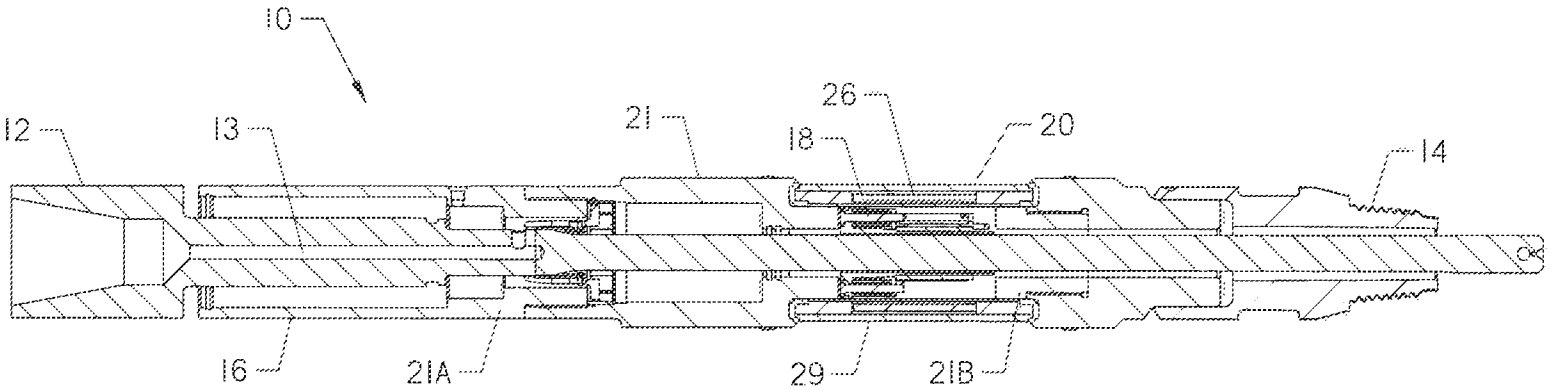
FIG. 7 is a cross-sectional view of another embodiment of a downhole tool having an external antenna disposed about both a housing wall and a beacon assembly.

In FIG. 1, the antenna assembly 20 and beacon assembly 18 are shown with linear displacement for clarity. One of skill in the art will appreciate that these assemblies may be placed at any location longitudinally relative to one another without critically impairing the spirit of this invention. In fact, the antenna assembly 20 may be disposed about a portion of the housing wall 21 that is disposed about the beacon assembly 18 as shown in FIG. 7.

With reference now to FIG. 5, an alternative embodiment of the antenna assembly 20 is shown. The antenna assembly 20 comprises a housing wall 21 with a first, large diameter portion 21*a* and a recessed, second portion 21*b*. The recessed portion 21*b* is covered, or filled, with a protective casing 29. The antenna coil 100 is wrapped around the housing wall 21 and within the protective casing 29. The protective casing 29 may comprise a urethane material or other magnetically transparent material. The antenna coil 100 is connected to the beacon assembly 18 (FIG. 1) through the feedthrough 104. The feedthrough 104 may comprise small radial holes made in the housing wall 21.

One skilled in the art will appreciate that the embodiments contained herein may be modified without departing from the spirit of the invention contained herein. For example, alternative sensors or antenna arrangements, and materials may be utilized.

What is claimed is:

1. A downhole tool coupled to a drill string comprising:

a sensor;

an antenna electronically connected to the sensor;

a wall disposed between the antenna and the sensor, the wall comprising a connection point for connection to the drill string;

a conductive, non-magnetic shield disposed between the wall and the antenna; and a non-conductive, non-magnetic tube disposed between the shield and the antenna.

2. The downhole tool of claim 1 wherein the antenna comprises a coil and a plurality of ferrite rods disposed between the coil and the wall.

3. The downhole tool of claim 2 wherein the sensor is disposed within the coil and within the wall.

4. The downhole tool of claim 1 wherein the sensor comprises an orientation sensor.

5. The downhole tool of claim 1 wherein the wall comprises a first portion and a second portion, wherein the first portion has a greater diameter than the second portion and wherein the sensor is located within the first portion and the antenna coil is disposed about the second portion.

6. The downhole tool of claim 1 further comprising a protective casing disposed about the antenna.

7. The downhole tool of claim 1 further comprising a generator driven by the drill string for powering the antenna.

8. The downhole tool of claim 1 further comprising an insulating gap between the shield and the wall.

9. A beacon assembly for attachment to a downhole end of a drill string, the beacon assembly comprising:

a housing wall;

a sensor located inside the housing wall;

a coil electronically connected to the sensor, the coil disposed outside of and about the housing wall;

an electromagnetically transparent protective casing located about the coil;

a conductive, non-magnetic shield disposed between the housing wall and the coil; and a non-conductive, non-magnetic tube disposed between the shield and the coil.

10. The beacon assembly of claim 9 wherein the electromagnetically transparent protective casing comprises ceramics.

* * * * *